US006154188A

United States Patent [19]

Learn et al.

[11] Patent Number: 6,154,188

[45] **Date of Patent: *Nov. 28, 2000**

[54] INTEGRATED METALLIZATION FOR DISPLAYS

[75] Inventors: Arthur J. Learn, Cupertino, Calif.; Duane A. Haven, Umpqua, Oreg.

[73] Assignee: Candescent Technologies Corporation, San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,386

[22] Filed: Apr. 30, 1997

[51] Int. Cl.[7] ..... G09G 3/22; H01J 1/62; H01J 15/00

[52] U.S. Cl. ..... 345/75.2; 313/496; 174/50.61

[58] Field of Search ..... 345/60, 204, 205, 345/206, 74, 75, 75.2; 65/59.21, 59.26; 313/318.07, 331, 317, 495, 583, 623, 626, 634, 496, 497; 438/937; 439/611, 612, 886; 174/50.32, 50.55, 50.61

[56] References Cited

U.S. PATENT DOCUMENTS

| | | | |
|---|---|---|---|
| 4,202,999 | 5/1980 | Holle et al. | 174/50.61 |
| 4,334,628 | 6/1982 | Buhrer et al. | 174/50.61 |
| 4,824,803 | 4/1989 | Us et al. | 438/612 |
| 4,908,546 | 3/1990 | Shaffer et al. | 313/331 |
| 5,157,304 | 10/1992 | Kane et al. | 313/495 |
| 5,175,067 | 12/1992 | Taylor et al. | 174/50.61 |
| 5,424,605 | 6/1995 | Lovoi | 313/495 |
| 5,518,805 | 5/1996 | Ho et al. | 438/643 |
| 5,559,399 | 9/1996 | Tanski et al. | 313/583 |
| 5,600,203 | 2/1997 | Namikawa et al. | 313/495 |
| 5,612,256 | 3/1997 | Stansbury | 438/20 |
| 5,764,001 | 6/1998 | Khan et al. | 313/583 |

*Primary Examiner*—Steven J. Saras
*Assistant Examiner*—Paul A Bell
*Attorney, Agent, or Firm*—Wagner, Murabito & Hao LLP

[57] ABSTRACT

A flat-panel display including a substrate, a viewing screen, a non-conductive ring, many row conductive electrodes, conductive pads and column buses. The ring vacuum-seals a cavity between the substrate and the viewing screen. Coupled to one surface of the substrate, the row conductive electrodes have a conductivity that is higher than the conductive pads. Each pad is connected to one row electrode, and each pad extends through the ring to allow electrical coupling to its corresponding row electrode from outside the cavity while vacuum is maintained inside the cavity. The row electrodes are substantially parallel to each other, and are substantially perpendicular to the column buses. The conductive electrodes are protected from exposure to the ring. In one embodiment, the ring is a frit seal, the row conductive electrodes are made of aluminum, and the column buses and the pads are made of chromium.

14 Claims, 5 Drawing Sheets

INTEGRATED METALLIZATION FOR DISPLAYS

BACKGROUND OF THE INVENTION

The present invention relates generally to flat-panel displays, and more particularly to large, high-resolution displays of the type in which data are input to picture-elements by means of electrical signals applied to the ends of data buses extending through a seal.

Transmission-line losses in a data bus of a flat-panel display result in attenuation of input signals on the bus. The losses also create picture-quality degradation, which typically takes the form of spatial nonuniformity.

These losses are a function of the capacitance and resistance of the data bus. The metal forming the line should be of low resistance especially for large size displays, which have long buses, and for high spatial resolution displays, which have narrow buses. Suitable metals having the appropriate conductivity include aluminum, copper, gold and silver.

In general, copper is considered to be unsuitable for use in displays based on emission of photons from cathode luminescent phosphors. This is because copper tends to cause uncontrolled color shifts as a contaminant in some phosphors. Gold and silver are expensive materials to be used extensively in cost-sensitive applications such as consumer display products.

Aluminum is a common, high-conductivity metal, widely used in low-cost consumer semiconductor and liquid-crystal display applications. However, thin film aluminum is subject to a condition known as Hillock formation, which is grain-growth in a direction orthogonal to the plane of the film. These Hillocks, if allowed to grow, can cause inter-electrode shorts.

One prior art technique to reduce Hillocks in the manufacture of an Active-Matrix Liquid-Crystal Display (a "AMLCD") is to use an alloy additive to the aluminum thin film. For large size and high resolution AMLCDs, the high-conductivity bus metal of choice is generally aluminum. When aluminum is used as the buried gate electrode in AMLCD (inverted-gate) Thin Film Transistor (TFT), Hillocks can cause inter-electrode shorts or defective transistors. Kawamura in the 1997 Proceedings of the Japan Display Conference reported the use of aluminum alloyed with zirconium to minimize Hillock formation at the expense of nearly doubling the resistivity. Aluminum is sometimes cladded with other metals to suppress Hillocks. Higachi in the 1996 SID Digest reported the use of aluminum cladded with molybdenum/tantalum, again increasing the resistivity of the metal. Thus, although alloying reduces the incidence of Hillocks, it introduces the unwanted effect of increasing bus resistivity.

A Field-Emission Display (a "FED") is typically characterized by a matrix of electron emitters, enclosed in a high-vacuum cavity bounded by an emitter substrate and a viewing screen. The cavity is sealed at its perimeter.

A constraint unique to FED and other high vacuum displays is the requirement of data buses to provide electrical continuity from the active area of the display, which is the area under vacuum, to the region of the display where electrical connection is made to the driving circuitry. Particularly in FED's, the requirement for vacuum in the range of $10^{-7}$ Torr dictates a high-temperature exhaust/sealing process. The seal material is typically a glassy material whose melting temperature is substantially lower than the temperature at which thermal damage would occur to any components of the device, which includes the aluminum buses. However, this sealing glass, or frit, is a good solvent for many materials, including aluminum, at its working or melting temperature. The dissolution of the metal bus in the frit-seal region can cause an unacceptable increase in bus resistance.

Note that the AMLCDs have problems less severe than the FEDs. In AMLCDs, the sealing processes are generally executed using low-temperature epoxy type sealing materials. These sealing processes have little effect on pure or alloyed aluminum, but are unsuitable for high-vacuum applications. Also, unlike the FEDs, other displays based on matrix-addressed device technologies, such as plasma and vacuum fluorescence ones, typically are in a size/resolution domain where one can use lower conductivity materials for the buses. This, in turn, allows the use of more robust materials to extend through the frit seal.

A number of materials, such as thin-film gold, platinum and tungsten, are insoluble in the frit. However, they are not "wetted" by the frit, and thus make a poor vacuum seal.

Another requirement for the data lines is that external electrical signals should be applied to the data bus pads without appreciable contact losses.

It should be obvious that for large-size, high-resolution FEDs, it is necessary to create low-resistance data buses with good frit-sealing and contact bonding properties. Additionally, if aluminum is selected to be the metal for the buses, Hillock formation should be significantly reduced.

SUMMARY OF THE INVENTION

The present invention provides low-resistive data buses with good frit-sealing and contact bonding properties for large-size and high-resolution field emitter displays. Other advantages offered by the present invention includes (1) providing data buses for displays with good picture-quality; (2) providing good bonding between external signal sources and data buses; (3) providing good perimeter vacuum seal; and (4) significantly reducing Hillock formation. These advantages are provided at relatively low cost.

In one embodiment, to achieve these and other advantages, the present invention uses pure or unalloyed aluminum as the material for data buses within the confines of the vacuum enclosure of the display. Then a part of each of the aluminum buses is cladded by chromium, with the chromium extended through the vacuum seal to make contact to external signal sources. Hillocks on the aluminum are significantly reduced by means of a layer of resistive material deposited as an overcoat over the aluminum buses.

In another embodiment, the field emitter displays have rows and columns of data buses to control the numerous field emitters. The row data buses are fabricated by the aluminum with chromium cladding as described above, while the column data buses are fabricated by chromium.

Other aspects and advantages of the present invention will become apparent from the following detailed description, which, when taken in conjunction with the accompanying drawings, illustrates by way of example the principles of the invention.

Same numerals in FIGS. 1–5 are assigned to similar elements in all the figures. Embodiments of the invention are discussed below with reference to FIGS. 1–5. However, those skilled in the art will readily appreciate that the detailed description given herein with respect to these figures is for explanatory purposes as the invention extends beyond these limited embodiments.

DETAILED DESCRIPTION OF THE INVENTION

Figure 1:
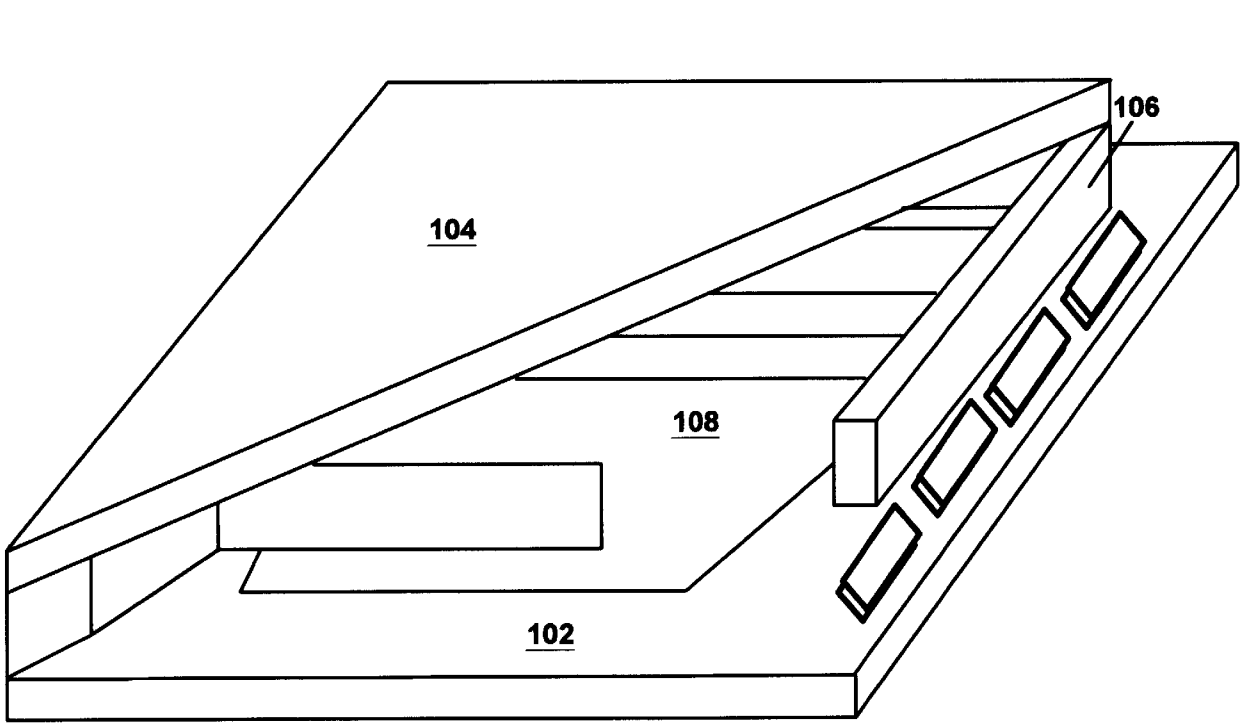
FIG. 1 shows an overall view of a field emitter display of the present invention.
Figure 2:
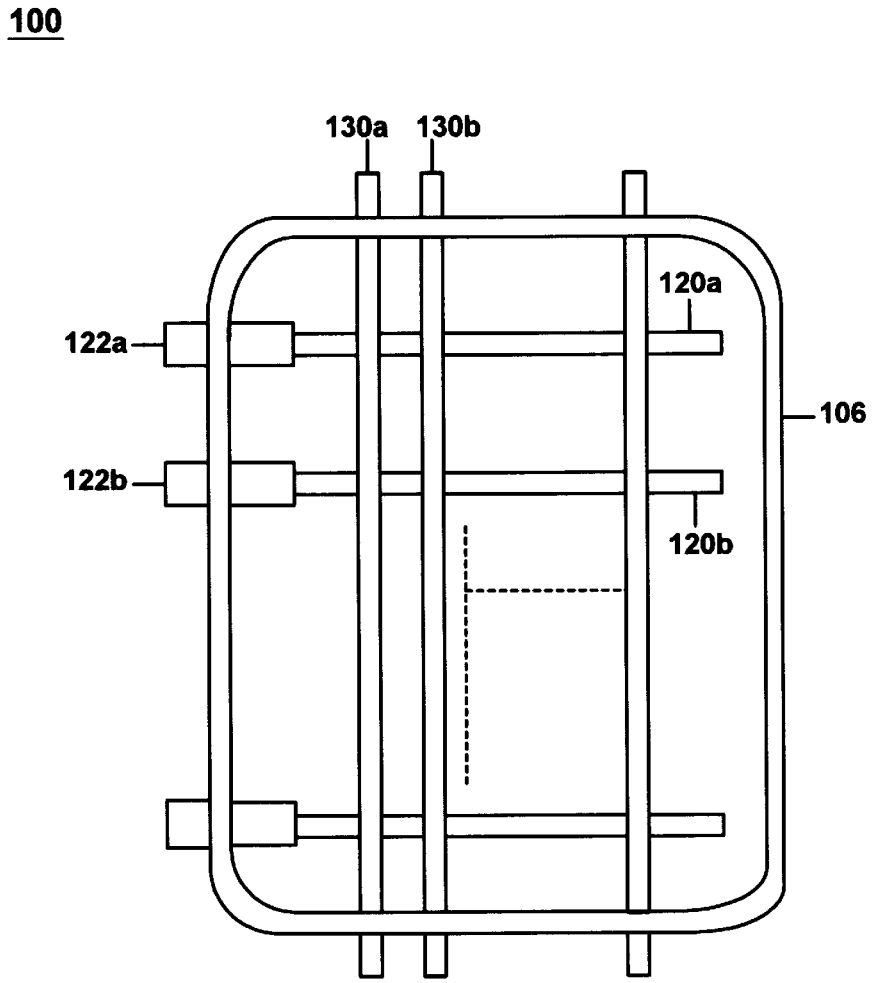
FIG. 2 illustrates the top view of data buses of the present invention.
Figure 3:
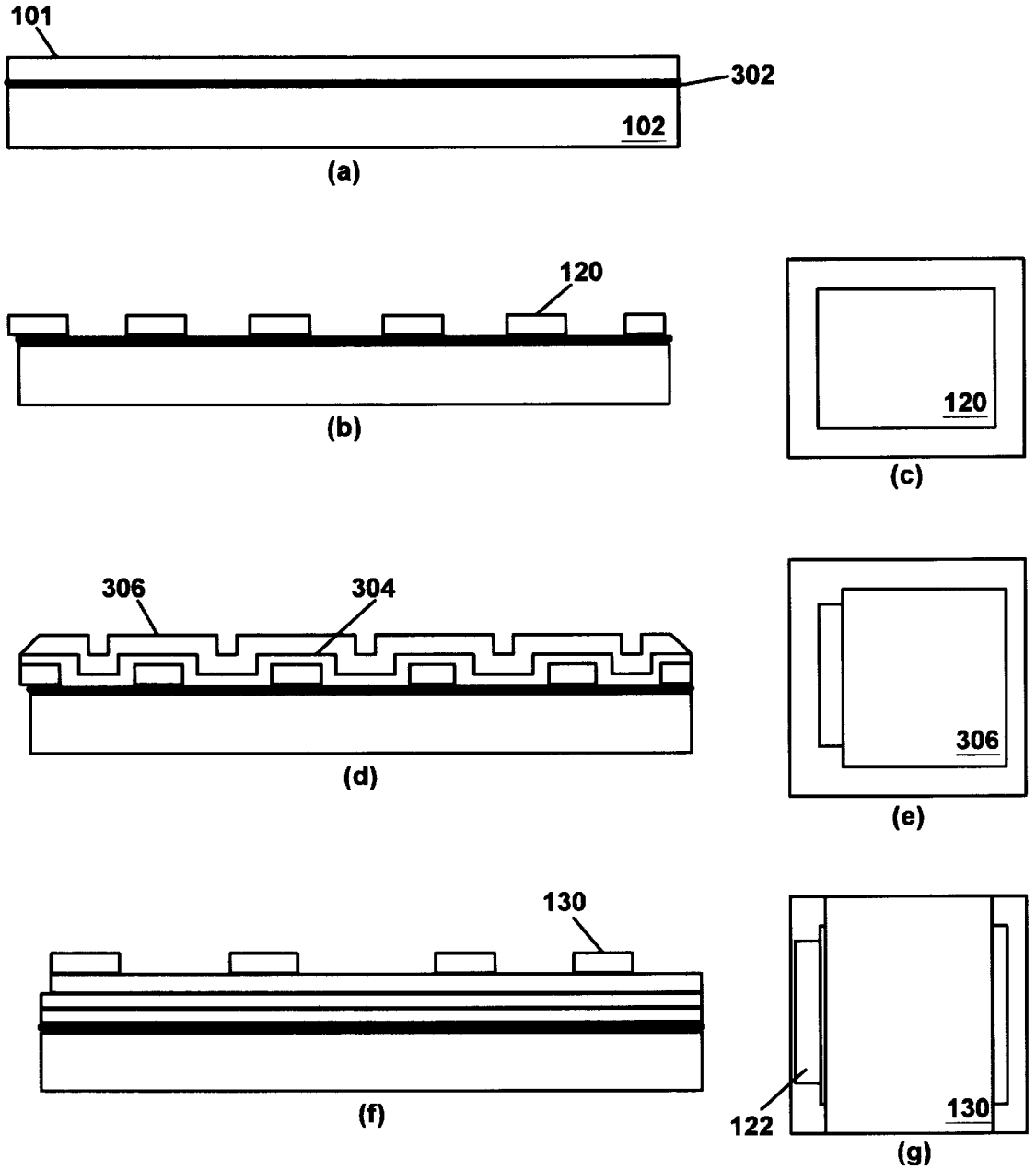
FIGS. 3A–G show one set of process sequence to fabricate one embodiment of the present invention.

FIG. 1 shows an overall view of a field emitter display of the present invention, while FIG. 2 illustrates the top view of data buses in the display. Many elements have been omitted, and different components in the figures are not drawn to scale so as to highlight a number of the inventive aspects.

Field emitter displays are used as the example to illustrate the present invention. However, other flat-panel displays, such as plasma displays, are equally applicable.

As shown in FIG. 1, the display 100 includes a substrate 102, a viewing screen 104 and a non-conductive ring 106—a frit seal in one embodiment—between the substrate 102 and the viewing screen 104. The frit seal 106 vacuum-seals a cavity 108 between the substrate 102 and the viewing screen 104. In one embodiment, the substrate 102 is made of glass, the viewing screen 104 includes luminescent materials on the surface facing the cavity 108, the frit seal 106 is made of solder-glass, and the vacuum-sealing process is compatible with frit glass vacuum sealing.

The display 100 includes a number of row data buses and column data buses. Each row bus includes two parts, a row conductive electrode 120 connected to a conductive pad 122. The row conductive electrodes 120 are coupled to one surface of the substrate 102. They are better illustrated in FIG. 2. Typically, they are periodically positioned, and are substantially parallel to each other.

Each pad is connected to one electrode, such as the pad 122*a* is connected to the electrode 120*a*. Each pad extends through the frit seal to allow electrical coupling to its corresponding electrode from outside the cavity 108 while vacuum is maintained inside the cavity.

The row buses are substantially perpendicular to the column buses, such as 130*a* and 130*b*. The column buses are again substantially parallel to each other. The control for a pixel source is positioned where a row bus directly couples capacitively to a column bus.

FIGS. 3A–G show one set of process sequence to fabricate one embodiment of the present invention. There are other approaches to fabricate the present invention.

First, aluminum metal 101 is sputtered, such as to a thickness of 100 nm, on the glass substrate 102. In one embodiment, an underlayer of silicon dioxide 302 is deposited by atmospheric pressure chemical vapor deposition (APCVD) prior to depositing the aluminum film. This underlayer prevents impurities in the glass from diffusing into the aluminum, which, in turn, prevents degrading the aluminum film's adhesion and conductivity properties. FIG. 3A shows a cross-sectional view of the substrate with the thin films deposited.

The aluminum metal is then patterned to form substantially parallel row electrodes 120, as illustrated in FIG. 3B. This patterning is by means of standard thin-film processes. For example, a layer of photosensitive resist material is coated on the aluminum film, and then exposed to actinic light through a mask to form a latent image of the row electrode pattern. The photoresist is then developed to produce an in-situ mask which resists etching. Aluminum is removed in regions not covered with photoresist by etching in a solution containing phosphoric acid, nitric acid and acetic acid. The photoresist is then removed typically by immersion in a solvent containing butyl acetate.

The domain of the row electrodes includes both the display region, and cladding contacts region disposed outside the display region, but within the area enclosed by the frit seal. In a typical FED display, the row electrodes require higher conductivity than the column electrodes, which will be deposited later.

The use of high-conductivity aluminum as row metal allows the electrodes to be both narrow and thin. These properties, respectively, provide high spatial resolution and allow good step coverage for subsequent layers to be deposited later.

FIG. 3B shows a cross-sectional view, and FIG. 3C a top view, of the substrate with the patterned row electrodes. In one embodiment, the electrodes are about 100 nm thick and 50 $\mu$m wide.

After the formation of the row electrodes, a layer of resistor film is deposited over the row electrodes. In one embodiment, the resistor film is a layer of SiC that is 200 nm thick. It is typically deposited by sputtering means, over the patterned aluminum electrodes. During the deposition of the resistor film, the substrate temperature is substantially the same as that used to deposit the aluminum film. The relatively thick resistor layer significantly inhibits Hillock formation in subsequent higher-temperature processing steps. A general discussion on the reduction in Hillock formation and their benefits can be found in an article, entitled "Suppression of Aluminum Hillock Growth by Overlayers of Silicon Dioxide Chemically-Vapor-Deposited at Low Temperature," written by Mr. Arthur J. Learn, and published in pages 774–776, Volume 4 of the Journal of Vacuum Science and Technology B, in 1986. The resistive layer covers locations where there will be crossover by the column bus electrodes. The resistive layer also leaves uncovered areas of row electrodes where cladding contact by column metal will subsequently be made—these areas of the row electrodes are known as the row cladding contacts.

In one embodiment, intermetal dielectric (IMD) 306 is deposited on the same locations as the resistor. For example, the film 306 consists of 200 nm SiO2 deposited by Chemical Vapor Deposition (CVD). FIG. 3D shows a cross-sectional view of the resistive film 304, and the dielectric film 306. FIG. 3E is a top view of these films showing one end of the row electrodes with the row cladding contacts left uncovered.

Then a column material is deposited over the substrate. In one embodiment, a layer of chromium is deposited by sputtering onto the silicon dioxide IMD and the exposed row cladding contacts. The chromium layer is then photo-patterned by standard photolithographic means to form: (1) an array of substantially parallel column buses disposed so they intersect with the row electrodes and (2) conductive pads 122 overlaying the row cladding contacts. Pads 122 make electrical contact to the row electrodes and extend under the frit seal to be formed.

The conductivity requirement for column buses is lower than that for the row electrodes. In one embodiment, chromium has been selected for the column material because it has sufficient conductivity, makes ohmic contact to aluminum, is a good material for bonding contact and has proven to be compatible with good frit seal. FIG. 3F shows a cross sectional view of the column data buses 130. FIG. 3G shows a top view of the column buses 130 and the conductive pads 122. In one embodiment, the column data buses 130 are about 200 nm thick and 66 $\mu$m wide, while the chromium pads are about 70 $\mu$m wide.

The above described approach increases the yield in the fabrication process. A thin row electrode reduces Hillock growth and step-coverage problems. This eliminates the need for the otherwise required, yield-limiting, slope-etching process on the row electrodes. The deposited resistor overcoat layer further reduces Hillock growth. Also, simultaneously depositing the pads and the column buses reduces extra masking and etching operations. With aluminum as the material for the row electrodes, the described approach does not require an intermediate adhesion-promoting layer over substrates, such as glass; it also does not require adhesion-promoting layer for overlayers, such as a silicon carbide or cermet resistive film. With reduced layers and process steps, and with Hillock suppression, the invention produces a higher yield display at a lower cost.

Finally, the non-conductive ring 106 is formed to generate the vacuum cavity 108. In one embodiment, hermetic sealing of the substrate 102 to the faceplate 104 is by means of a preformed ring of solder-glass (frit) material disposed either on a perimeter spacer (element 350 in FIG. 4), or on the patterned substrate, or on the faceplate 104. The substrate 102 and the faceplate 104, acting as an assembly, are aligned so as to provide correspondence between emitter and phosphor pixel. Then the assembly is evacuated and is subjected to temperature sufficient to melt or "work" the frit preform to seal the substrate 102 and the faceplate 104 together. In this embodiment, the frit seal is made only to the chromium films—both to the patterned column data buses and to the conductive pads. The surface of the chromium films forms tenacious oxides with some solubility in the frit seal to generate good vacuum seals. Such formation substantially maintains the conductivity of the chromium films.

Figure 4:
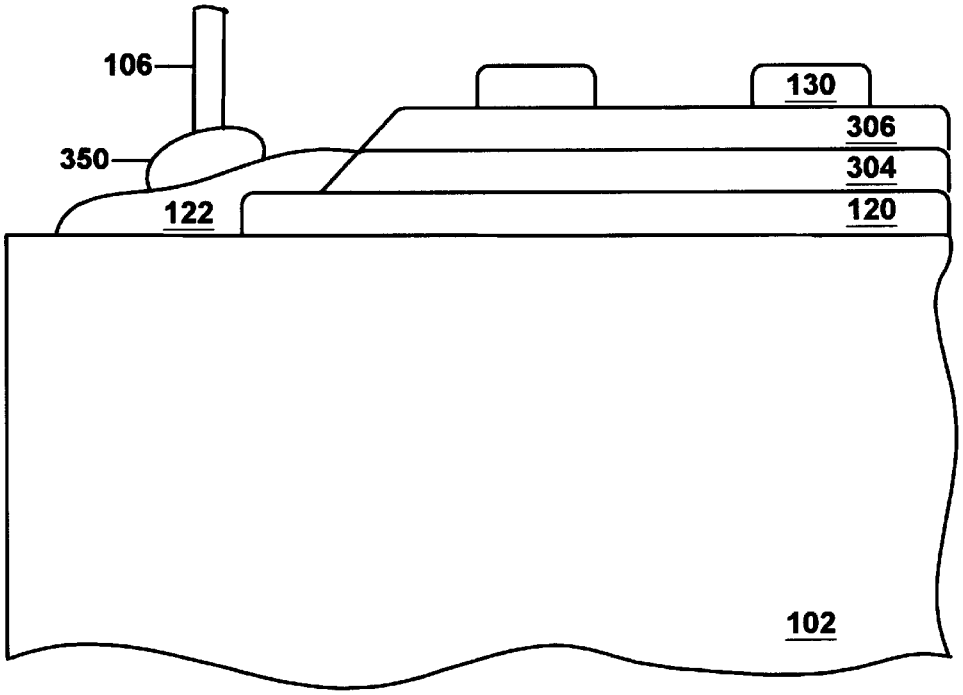
FIG. 4 shows a cross-sectional view of one embodiment of the present invention.

As shown in FIG. 4, the pads extend through the frit seal. That figure shows a conductive pad 122 in contact with a row electrode 120. The pad 122 extends through a perimeter spacer 350 and the frit seal 106. In this embodiment, the pads, but not the row electrodes, extend through the frit.

With the invented configuration, optimum choices can independently be made for the high conductivity row electrodes and the frit-compatible conductive pads. This will improve the display performance and yield, respectively. Further, degradation effects, such as corrosion of the high conductivity row electrodes, are avoided. Thus reliability improves.

Figure 5:
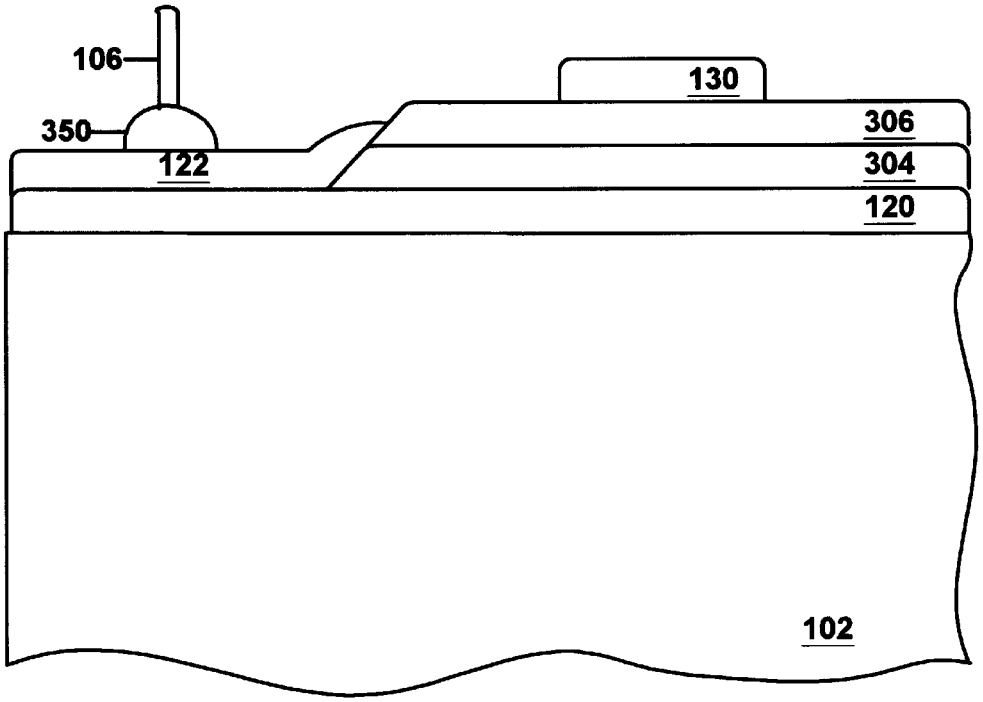
FIG. 5 shows a cross-sectional view of another embodiment of the present invention.

FIG. 5 illustrates a cross-sectional view of another embodiment where the row electrodes also extend under the frit seal region for substantially the entire length of the conductive pads. Each of the electrodes is cladded by a conductive pad at least in the region where the pad is making frit seal. Consequently, the row electrodes are not exposed to the frit seal. Also, the pads cover the ends of the row electrodes so that the row electrodes are not exposed to the atmosphere.

The invention selects high conductivity materials for the row electrodes, such as higher than $3\times10^5\ \Omega^{-1}\text{cm}^{-1}$. Such conductivity allows the electrodes to be longer, narrower, and closer together than prior art buses. In one embodiment, a field-emitter display as large as 340 mm by 320 mm, with a resolution of 106 pixels/inch, has been successfully manufactured based on the present invention.

In the present invention, the pads are made of a material that is different from the row electrodes, with the pads selected from materials that are less corrosion-prone. This is because the row electrodes are confined to either the vacuum cavity, or are suitably cladded with a protective coating in the contact pad area. However, the pads are in direct contact with the melting frit, and are exposed to the atmosphere. Thus, the material of the pads should be less corrosion-prone. Since a part of the column buses are similarly exposed, they should also be generated by a material that is less corrosion-prone. Again, materials other than chromium are applicable for the pads, such as molybdenum, tantalum and niobium.

In the above description, the conductive electrodes are made of one material, and the conductive pads are made of another material. However, each material does not have to be a single element in the periodic table; each material can be an alloy or a compound.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A flat panel display comprising:

a substrate;

a viewing screen;

a non-conductive ring disposed between said substrate and said viewing screen to vacuum-seal a cavity between said substrate and said viewing screen;

a plurality of first conductive electrodes coupled to one surface of said substrate, said plurality of first conductive electrodes formed of a first conductive material that has a high conductivity;

a plurality of second conductive electrodes formed of a second conductive material, said second conductive material having a conductivity that is lower than the conductivity of said first conductive material; and a plurality of conductive pads formed of said second conductive material, each of said plurality of conductive pads at least partially overlying one of said plurality of first conductive electrodes and electrically coupled to one of said plurality of first conductive electrodes, each of said plurality of conductive pads directly underlying said non-conductive ring and extending out of said cavity such that a vacuum is maintained within said cavity.

2. A display as recited in claim 1 wherein said ring is a frit seal.

3. A display as recited in claim 2 further comprising a thin-film resistor disposed over said plurality of first conductive electrodes.

4. A display as recited in claim 3 wherein the thin-film resistor is made of cermet.

5. A display as recited in claim 2, wherein to vacuum-seal the cavity, said frit seal melts and fuses with the surface of said conductive pads to ensure the vacuum seal.

6. A display as recited in claim 1 wherein said first conductive material comprises aluminum.

7. A display as recited in claim 6 wherein said second conductive material comprises chromium.

8. A display as recited in claim 7 wherein said plurality of first conductive electrodes are row electrodes that are substantially parallel to each other, and wherein said plurality of second conductive electrodes are column electrodes, said column electrodes disposed substantially perpendicularly to said row electrodes.

9. A flat panel display comprising:

a substrate;

a viewing screen;

a non-conductive ring disposed between said substrate and said viewing screen to vacuum-seal a cavity between said substrate and said viewing screen;

a plurality of first conductive electrodes coupled to one surface of said substrate, said plurality of first conductive electrodes formed of a first conductive material that has a high conductivity;

a plurality of second conductive electrodes formed of a second conductive material, said plurality of second conductive electrodes disposed above said plurality of first conductive electrodes, said second conductive material having a conductivity that is lower than the conductivity of said first conductive material; and a plurality of conductive pads formed of said second conductive material, said plurality of conductive pads formed concurrently with the formation of said plurality of second conductive electrodes, each of said plurality of conductive pads at least partially overlying one of said plurality of first conductive electrodes and electrically coupled to one of said plurality of first conductive electrodes, each of said plurality of conductive pads directly underlying said non-conductive ring and extending out of said cavity such that a vacuum is maintained within said cavity.

10. A display as recited in claim 9 wherein the display is a field emitter display.

11. A display as recited in claim 9 further comprising a thin-film resistor disposed over said plurality of first conductive electrodes.

12. A display as recited in claim 11 wherein said thin-film resistor is made of cermet.

13. A display as recited in claim 11 wherein said thin-film resistor is made of sputtered silicon carbide.

14. A flat panel display comprising:

a substrate;

a viewing screen;

a frit seal disposed between said substrate and said viewing screen to vacuum-seal a cavity between said substrate and said viewing screen;

a plurality of first conductive electrodes coupled to one surface of said substrate, said plurality of first conductive electrodes formed of aluminum;

a thin-film resistor disposed over said plurality of first conductive electrodes;

a plurality of second conductive electrodes formed of chromium, said plurality of second conductive electrodes disposed above said thin-film resistor; and a plurality of conductive pads, said plurality of conductive pads formed concurrently with the formation of said plurality of second conductive electrodes, each of said plurality of conductive pads electrically coupled to one of said plurality of first conductive electrodes, each of said plurality of conductive pads directly underlying said frit seal and extending out of said cavity such that a vacuum is maintained within said cavity.

* * * * *